US007527872B2

(12) United States Patent
Steele et al.

(10) Patent No.: US 7,527,872 B2
(45) Date of Patent: May 5, 2009

(54) TREATED ALUMINUM ARTICLE AND METHOD FOR MAKING SAME

(75) Inventors: Leslie Scotte Steele, Greenville, OH (US); Brian Brandewie, Sidney, OH (US)

(73) Assignee: Goodrich Corporation, Charlotte, NC (US)

( * ) Notice: Subject to any disclaimer, the term of this patent is extended or adjusted under 35 U.S.C. 154(b) by 288 days.

(21) Appl. No.: 11/258,395

(22) Filed: Oct. 25, 2005

(65) Prior Publication Data

US 2007/0092739 A1 Apr. 26, 2007

(51) Int. Cl.
*B32B 9/04* (2006.01)
*C25D 9/06* (2006.01)

(52) U.S. Cl. ..... 428/447; 205/121; 205/316; 205/318; 205/319; 205/323; 205/324; 428/304.4; 428/307.3; 428/307.7; 428/312.2; 428/312.8; 428/314.4; 428/318.4; 428/450

(58) Field of Classification Search ..... None
See application file for complete search history.

(56) References Cited

U.S. PATENT DOCUMENTS

| | | | | |
|---|---|---|---|---|
| 2,692,851 | A | 10/1954 | Burrows | |
| 3,274,078 | A | 9/1966 | Tsuji | |
| 3,975,197 | A * | 8/1976 | Mikelsons | 430/525 |
| 4,330,446 | A | 5/1982 | Miyosawa | 523/409 |
| 4,894,127 | A | 1/1990 | Wong et al. | |
| 5,158,663 | A | 10/1992 | Yahalom | |
| 5,194,138 | A | 3/1993 | Mansfield et al. | 205/183 |
| 5,292,549 | A | 3/1994 | van Ooij et al. | 427/156 |
| 5,362,569 | A | 11/1994 | Bauman | 428/472.2 |
| 5,399,210 | A | 3/1995 | Miller | 148/273 |
| 5,433,976 | A | 7/1995 | van Ooij et al. | 427/327 |
| 5,439,747 | A | 8/1995 | Sturdevant et al. | 428/447 |
| 5,447,745 | A * | 9/1995 | Descamps | 427/8 |
| 5,486,283 | A | 1/1996 | Mnich | 205/174 |
| 5,750,197 | A | 5/1998 | van Ooij et al. | 427/318 |
| 5,759,629 | A | 6/1998 | van Ooij et al. | 427/384 |
| 5,775,892 | A | 7/1998 | Miyasaka et al. | 418/55.2 |
| 5,851,373 | A | 12/1998 | Kubota et al. | 205/139 |
| 5,863,621 | A | 1/1999 | Dearnaley et al. | 427/523 |
| 5,865,911 | A * | 2/1999 | Miyasato et al. | 148/439 |
| 5,879,475 | A * | 3/1999 | Karabin | 148/417 |
| 5,929,159 | A | 7/1999 | Schutt et al. | 524/544 |
| 6,001,481 | A | 12/1999 | Dearnaley et al. | 428/408 |
| 6,042,896 | A | 3/2000 | Rodriguez et al. | 427/523 |
| 6,106,901 | A | 8/2000 | Song et al. | 427/387 |
| 6,171,704 | B1 * | 1/2001 | Mosser et al. | 428/450 |
| 6,372,115 | B1 | 4/2002 | Miyasaka et al. | 205/204 |
| 6,440,290 | B1 | 8/2002 | Vega et al. | 205/201 |
| 6,509,101 | B2 * | 1/2003 | Fairbourn | 428/447 |
| 6,511,532 | B2 | 1/2003 | Matzdorf et al. | 106/14.44 |
| 6,562,223 | B2 | 5/2003 | Rasmussen | 205/324 |
| 2002/0132105 | A1 * | 9/2002 | Robertson et al. | 428/315.5 |
| 2002/0157961 | A1 | 10/2002 | Dattilo et al. | 205/328 |
| 2003/0057100 | A1 | 3/2003 | Wang et al. | 205/328 |
| 2003/0196907 | A1 | 10/2003 | Viola | 205/324 |
| 2003/0232201 | A1 | 12/2003 | Byrd et al. | 428/447 |
| 2004/0034109 | A1 | 2/2004 | Ostrovsky | 516/38 |
| 2004/0166333 | A1 * | 8/2004 | Byrd et al. | 428/447 |
| 2004/0261916 | A1 * | 12/2004 | Lin et al. | 148/549 |
| 2006/0037685 | A1 * | 2/2006 | Clements et al. | 152/396 |

FOREIGN PATENT DOCUMENTS

| | | |
|---|---|---|
| DE | 102 26 737 | 1/2004 |
| EP | 0 545 785 | 6/1993 |
| EP | 0 758 029 | 7/1995 |

OTHER PUBLICATIONS

Data outlining the makeup of Al alloy 1145 taken from the Comet Metals internet site.*

Data outlining the makeup of Al alloy 3003 taken from the Wilkinson Steel internet site.*

European Search Report issued in corresponding European Application No. 06 118 156.6 dated Dec. 29, 2008.

Abel et al.; "The Interaction of γ-Glycidoxypropyltrimethoxysilane with Oxidised Aluminum Substrates: The Effect of Drying Temperature" *J. Adhesion*, 2000, vol. 73, pp. 313-340.

Adsil Product Brochure; "Corrosion Exposure Chart"; Revised Sep. 7, 2001.

Adsil web page printout on SiLON Automotive Products; www.adsil.com.

Adsil, Inc.; Technical Data Sheet TS-17; MicroBrite™ Non-Ferrous Metal Clear Protectant AD65.

Adsil, Inc.; Technical Data Sheet TS-27; MicroGuard® Corrosion Protector Clear Treatment AD95.

Adsil Material Safety Data Sheet; MicroBrite™ Non-Ferrous Metal Clear Protectant AD65 (Part A).

(Continued)

*Primary Examiner*—Marc S Zimmer
(74) *Attorney, Agent, or Firm*—Renner, Otto, Boisselle & Sklar, LLP

(57) ABSTRACT

The disclosed invention relates to an article, comprising: a substrate having a surface comprising aluminum or an aluminum alloy; a sealed anodic coating layer overlying at least part of the surface of the substrate; and a layer of a silicon-containing polymer overlying the sealed anodic coating layer. The article may be useful as a brake or wheel component.

26 Claims, No Drawings

OTHER PUBLICATIONS

Adsil Material Safety Data Sheet; MicroGuard® Corrosion Protector Clear Treatment AD95 (Part A).

Adsil Material Safety Data Sheet; MicroGuard® Corrosion Protector Clear Treatment AD95 (Part B).

Alcoa Brochure; "Alcoa Dura-Bright® Wheels."

Alcoa web page printout; Alcoa Dura-Bright® Wheels, Heavy Truck Fleets; www.dontpolish.com; 2002.

ASTM B244-97, "Standard Test Method for Measurement of Thickness of Anodic Coatings on Aluminum and of Other Nonconductive Coatings on Nonmagnetic Basis Metals with Eddy-Current Instruments"; ASTM International; 2002.

ASTM B580-97, "Standard Specification for Anodic Oxide Coatings on Aluminum"; ASTM International; 2000.

Benavides; "Closing the Corrosion Window: Ambient Temperature Cured Glass on U.S. Coast Guard Aircraft."

Bexell et al.; Characterization of a non-organofunctional silane film deposited on Al, Zn and Al-43.4Zn-1.6Si alloy-coated steel; Part I; *Surface and Interface Analysis*; 2001; 31:212-222.

Bexell et al.; "Characterization of a non-organofunctional silane film deposited on Al, Zn and Al-43.4Zn-1.6Si alloy-coated steel"; *Surface and Interface Analysis*; Part II; 2001; 31:223-231.

Daycon Product Information Sheet for Durashield; Jan. 26, 1999.

Embury Company; "Alloys Suitable for Anodizing"; ww.emburycompany.com.

Embury Company; "Anodizing Reference"; Reference Guide; www.emburycompany.com.

Fang et al.; "A characterization of the γ-glycidoxypropyltrimethoxysilane and aluminum interface by SIMS and XPS"; *Journal of Materials Science Letters*; 16 (1997) 1676-1676.

Greig; "Technical Factors Accounting for Double-digit Energy Efficiency Improvement Accruing from Cleaning and Treatement of A/C Condenser Coils with Adsil MicroGuard™ Reactive Silanol"; Jun. 2003 (updated Jan. 2004).

Greig; "Recent Tests and Evaluations of Reactive Silane Surface Treatments in Military Applications"; NACE International; 2003.

Ling Halo; Metalast Technical Reports; "Sealing: Enhance Anodic Coatings' Performance"; 2001.

Military Specification MIL-A-8625F; "Anodic Coatings for Aluminum and Aluminum Alloys"; 2003.

Roberts; Paint & Coatings Industry; "Proven Non-Chromated Technology"; www.pcimag.com: 2004.

Reboul; "A ten-step mechanism for the pitting corrosion of aluminum"; *Materials Science Forum*; vols. 217-222 (1996); pp. 1553-1558.

The Engineering Society for Advancing Mobility Land Sea Air and Space International; Aerospace Material Specification AMS-A-8625; Anodic Coatings for Aluminum and Aluminum Alloys; 2000.

Sheasby et al.; "The Fundamentals of Anodizing"; *The Surface Treatment and Finishing of Aluminum and Its Alloys*; vol. 1, Sixth Edition, pp. 327-329, 2001.

SDC Technologies Inc., Technical Data Sheet for Crystal Coat™ MP-100, Oct. 29, 2003.

SDC Technologies Inc., Safety Data Sheet for Crystal Coat MP-100, Jun. 9, 2003.

* cited by examiner

TREATED ALUMINUM ARTICLE AND METHOD FOR MAKING SAME

TECHNICAL FIELD

This invention relates to treated aluminum articles and to a method for making the treated aluminum articles. More particularly, the invention relates to an article, comprising: a substrate having a surface comprising aluminum or an aluminum alloy; a sealed anodic coating layer overlying at least part of the surface of the substrate; and a layer of a silicon-containing polymer overlying the sealed anodic coating layer. These articles may have a variety of uses including use as brake and wheel components, for example, aircraft brake and wheel components.

BACKGROUND

Aluminum alloys that are used in wheel structures for aircraft include Aluminum Association Series alloys 2014-T6, 2040-T6 and 7050-T74. These alloys are specific alloys within the Aluminum Association Series of alloy classes 2XXX and 7XXX, respectively. These alloys are attractive due to their high strength and fracture toughness characteristics. Although the 2XXX and 7XXX aluminum alloys exhibit high strength characteristics they are more prone to corrosion than other aluminum alloys. This corrosion includes general corrosion, pitting, stress corrosion cracking, and intergranular attack.

A useful method for dealing with the corrosion of aluminum surfaces in aircraft wheel structures involves the application of a sulfuric acid anodic coating in combination with a sodium dichromate sealant to the aluminum surface followed by the application of a chromated epoxy primer and a polyurethane topcoat. However, a problem with this method relates to the fact that current maintenance practices for aircraft wheels require a fluorescent penetrant inspection (FPI) during every major overhaul. In order to perform this inspection, the paint must be stripped. Following inspection the paint is then reapplied. The task of stripping and reapplying the paint for FPI inspection during maintenance and overhaul is labor intensive and may involve the use of environmentally polluting materials.

The problem therefore is to provide these wheel structures with protection from corrosion without having to employ such stripping and reapplication procedures. This invention, in at least one embodiment, provides a solution to this problem. In one embodiment, the invention provides wheel corrosion protection that achieves a reduction in maintenance costs and avoids the use of environmentally polluting materials. The corrosion protection provided by this invention is also applicable to other aluminum articles.

SUMMARY

This invention relates to an article, comprising: a substrate having a surface comprising aluminum or an aluminum alloy; a sealed anodic coating layer overlying at least part of the surface of the substrate; and a layer of a silicon-containing polymer overlying the sealed anodic coating layer.

In one embodiment, the invention relates to a method of treating a substrate having a surface comprising aluminum or an aluminum alloy, the method comprising: forming an anodic coating layer overlying at least part of the surface of the substrate; sealing the anodic coating layer to form a sealed anodic coating layer; and forming a silicon-containing polymer layer overlying the sealed anodic coating layer.

In one embodiment, the invention relates to a method of treating a substrate, the substrate having a surface comprising an aluminum alloy, the process comprising: forming an anodic coating layer overlying at least part of the surface of the substrate, the anodic coating layer being formed using a sulfuric acid bath; sealing the anodic coating layer using water and/or a sealing solution to form a sealed anodic coating layer, the sealing solution comprising water and one or more of sodium dichromate, potassium dichromate, nickel acetate or cobalt acetate; and forming a silicon-containing polymer layer over the sealed anodic coating layer, the silicon containing polymer being derived from at least one alkoxysilane, at least one inorganic siloxane, or a mixture thereof.

DETAILED DESCRIPTION

The article that is provided by this invention may be any article that has a surface comprising aluminum or an aluminum alloy. The article may be a brake or wheel component. The brake or wheel component may be an aircraft brake or wheel component.

The aluminum or aluminum alloy may be any aluminum or aluminum alloy that is suitable for anodizing. In one embodiment, the alloying constituent may comprise copper, manganese, silicon, magnesium, zinc, zirconium, silver, or a mixture of two or more thereof. In one embodiment, the alloying constituent may comprise copper, and in one embodiment, it may comprise zinc. Included in this group are the aluminum and aluminum alloys that meet the standards set by the Aluminum Association for Series 1000 through 7000 alloys. Also included are the 300.0 cast aluminum alloys. These are sometimes referred to as 1XXX through 7XXX and 3XX.X. These are taken from the Aluminum Association standards for aluminum and aluminum alloys, which are incorporated herein by reference. These are described in the table below.

| Series | Major Alloying Constituents | Metal Properties | Typical Uses |
|---|---|---|---|
| 1XXX | None | Soft, conductive | Cans, architectural structures |
| 2XXX | Copper | Very strong, hard, low elongation | Aircraft, automotive, mechanical structures |
| 3XXX | Manganese | Strong, small grains | Cans, architectural structures, lighting |
| 4XXX | Silicon | Strong, fluid | Architectural structures, marine applications, welding wire |
| 5XXX | Magnesium | Strong, ductile, fluid | Architectural structures, welding wire, lighting |
| 6XXX | Magnesium and silicon | Strong, ductile | Automotive, architectural structures, marine applications |
| 7XXX | Zinc | Very strong | Automotive, aircraft |
| 3XX.X | Silicon plus copper and/or magnesium | Strong | Automotive, aircraft, mechanical structures |

The aluminum alloy may be a wrought alloy. In one embodiment, the aluminum alloy may meet the standards set by the Aluminum Association for a Series 2009, 2014, 2016, 2017, 2024, 2040, 2080, 2117, 2214, 2618, 6013, 6061, 6091, 6092, 6113, 7005, 7009, 7010, 7033, 7049, 7050, 7075, 7085, 7093, 7175 or 7250 alloy.

In one embodiment, the alloy may be a series 2014-T6 or 2014-T651 alloy. These may comprise from about 90.4 to about 95% by weight aluminum, from about 3.9 to about 5% by weight copper, from about 0.2 to about 0.8% by weight magnesium, from about 0.4 to about 1.2% by weight manganese, from about 0.5 to about 1.2% by weight silicon, up to about 0.1% by weight chromium, up to about 0.7% by weight iron, up to about 0.15% by weight titanium, and up to about 0.25% by weight zinc. These may contain up to about 0.15% by weight of one or more other metals.

In one embodiment, the alloy may be a series 2040-T6 alloy. This alloy may comprise from about 91.2 to 93.6% by weight aluminum, from about 4.8 to about 5.4% by weight of copper, from about 0.7 to about 1.1% by weight magnesium, from about 0.45 to about 1.0% by weight manganese, from about 0.40 to about 0.70% by weight silver, from about 0.08 to about 0.15% by weight of zirconium, up to about 0.25% by weight zinc, up to about 0.10% by weight iron, up to about 0.08% by weight silicon, up to about 0.06% by weight titanium, and up to about 0.05% by weight chromium. These may contain up to about 0.15% by weight of one or more additional metals.

In one embodiment, the alloy may be a series 7050-T74 alloy. This alloy may comprise from about 87.3 to about 90.3% by weight aluminum, from about 5.7 to about 6.7% by weight zinc, from about 2 to about 2.6% by weight copper, from about 1.9 to about 2.6% by weight magnesium, from about 0.08 to about 0.15% by weight zirconium, up to about 0.04% by weight chromium, up to about 0.15% by weight iron, up to about 0.06% by weight titanium, up to about 0.1% by weight manganese, and up to about 0.12% by weight silicon. This alloy may contain up to about 0.15% by weight of one or more other metals.

The aluminum alloy may be a cast aluminum alloy. In one embodiment, the alloy may meet the standards set by the Aluminum Association for a Series 3XX.X alloy. These include Series 355.0, C355.0, 356.0, A356.0 and A357.0 alloys.

The anodic coating layer may be formed on a surface of an aluminum or aluminum alloy substrate or workpiece using an anodizing process as described below. This may be preceded by a cleaning/etching step which may involve a first step of cleaning, followed by rinsing, then followed by a second step of etching in an alkaline or acidic medium (for example, an aqueous solution of sodium hydroxide or an aqueous solution of sulfuric acid or chromic acid), followed by further rinsing. Alternatively, a solution capable of performing cleaning and etching directly in a single step may be used. This may be accomplished using a solution comprising phosphoric acid and anionic wetting agents. The cleaning/etching step may be followed by a desmutting or deoxidizing step using, for example, nitric acid.

The anodic coating layer may be formed on the aluminum or aluminum alloy substrate or work piece using an aqueous anodizing bath. The bath may be a sulfuric acid bath, a chromic acid bath or a phosphoric acid bath. The sulfuric acid bath may have a sulfuric acid concentration in the range from about 160 to about 240 grams per liter (g/l), and in one embodiment from about 160 to about 180 g/l, and in one embodiment from about 165 to about 202 g/l, and in one embodiment from about 180 to about 225 g/l. The temperature of the bath may be in the range from about −4° C. to about 27° C., and in one embodiment from about −4° C. to about 10° C., and in one embodiment from about 14° C. to about 22° C., and in one embodiment from about 16° C. to about 27° C., and in one embodiment from about 20° C. to about 22° C. The workpiece may be dipped or immersed in the bath and a voltage may be applied to the workpiece. The voltage may be in the range from about 12 to about 60 volts, and in one embodiment from about 12 to about 16 volts, and in one embodiment from about 13 to about 22 volts, and in one embodiment from about 16 to about 22 volts, and in one embodiment from about 20 to about 25 volts, and in one embodiment from about 25 to about 60 volts. The current density may be in the range from about 96 to about 430 amps per square meter ($A/m^2$), and in one embodiment from about 118 to about 140 $A/m^2$, and in one embodiment from about 108 to about 160 $A/m^2$, and in one embodiment from about 96 to about 130 $A/m^2$, and in one embodiment from about 105 to about 215 $A/m^2$, and in one embodiment from about 160 to about 430 $A/m^2$. The workpiece may be maintained in the bath until the anodic coating is formed at a thickness in the range from about 0.5 to about 115 microns, and in one embodiment from about 0.5 to about 18 microns, and in one embodiment from about 2 to about 25 microns, and in one embodiment from about 5 to about 10 microns, and in one embodiment from about 8 to about 15 microns, and in one embodiment from about 12 to about 115 microns. The thickness of the anodic coating layer may be determined using the procedures specified in ASTM B244-97. The anodic coating may be dyed or non-dyed. In one embodiment, the anodic coating may be applied using a sulfuric acid bath in accordance with Military Specification MIL-A-8625F, Type II or IIb, Class 1, or Type III, Class 1.

The chromic acid bath may have a chromic acid concentration in the range from about 3 to about 10% by weight, and in one embodiment from about 5 to about 10% by weight. The temperature of the bath may be in the range from about 30° C. to about 40° C., and in one embodiment from about 30° C. to about 32° C. The workpiece may be dipped or immersed in the bath and a voltage may be applied to the workpiece. The voltage may be in the range from about 22 to about 60 volts, and in one embodiment from about 22 to about 40 volts, and in one embodiment from about 40 to about 60 volts, and in one embodiment from about 38 to about 42 volts. The current density may be in the range from about 10 to about 110 $A/m^2$, and in one embodiment from about 10 to about 50 $A/m^2$, and in one embodiment from about 10 to about 30 $A/m^2$, and in one embodiment from about 50 to about 110 $A/m^2$. The workpiece may be maintained in the bath until the anodic coating is formed at a thickness in the range from about 2 to about 7 microns, and in one embodiment from about 2 to about 5 microns, and in one embodiment from about 4 to about 7 microns. The anodic coating may be dyed or non-dyed. In one embodiment, the anodic coating may be applied using a chromic acid bath in accordance with Military Specification MIL-A-8625F, Type I or Ib, Class 1 or Class 2.

The phosphoric acid bath may have a phosphoric acid concentration in the range from about 3 to about 60% by weight. The temperature of the bath may be in the range from about 15° C. to about 35° C. The workpiece may be dipped or immersed in the bath and a voltage may be applied to the workpiece. The voltage may be in the range from about 10 to about 60 volts. The current density may be in the range from about 30 to about 120 $A/m^2$. The workpiece may be maintained in the bath until the anodic coating is formed at a thickness in the range from about 0.1 to about 1 micron.

The anodic coating layer may contain pores which form during the anodic coating process. In one embodiment, the anodic coating layer may comprise a barrier region overlying the aluminum or aluminum alloy surface of the substrate and a porous region overlying the barrier region. The barrier region may be a thin continuous layer having a thickness in the range from about 0.1 to about 0.3 microns, and in one embodiment from about 0.15 to about 0.25 microns. The porous region may comprise pores that are open on the outside surface of the anodic coating layer and, in one embodiment, penetrate from the outside surface to the barrier region. The pores may be micropores. In one embodiment, the pores may be hexagonally shaped. Pore attributes, such as the spacing between pores, pore uniformity, cell wall thickness, and depth and the width of the pores may be controlled by selecting process parameters including voltage, solution concentration, substrate type, time for processing, temperature of solution, and the like. In one embodiment, the pore dimensions may include depths in the range up to about 60 microns, and in one embodiment depths in the range from about 2.5 to about 60 microns; and widths in the range up to about 150 nanometers (nm), and in one embodiment in the range from about 25 to about 150 nm. The cell walls may have thicknesses in the range up to about 75 nm, and in one embodiment from about 13 to about 75 nm.

The anodic coating layer may be sealed by applying a sealing solution to the anodic coating layer. In one embodiment, the pores in the anodic coating layer may be at least partially closed or sealed by the sealing solution. In one embodiment, the pores may be substantially closed or sealed, and in one embodiment they may be completely closed or sealed.

The sealing solution may comprise a dichromate sealing solution which may comprise sodium dichromate, potassium dichromate, or a mixture thereof. In one embodiment, the sealing process using the dichromate sealing solution may comprise the following reactions: (1) the absorption of chromate; and (2) the closing of pores by contact with hot water which also locks in the chromate in the pores.

These reactions may be as follows:

Reaction 1

Forming aluminum oxychromate in the the anodic layer region:

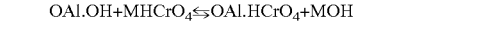

$$OAl.OH+MHCrO_4 \leftrightarrows OAl.HCrO_4+MOH$$

for a pH equal to or less than about 6; and/or forming aluminum dioxychromate in the anodic layer region:

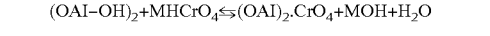

$$(OAI-OH)_2+MHCrO_4 \leftrightarrows (OAI)_2.CrO_4+MOH+H_2O$$

for a pH equal to or greater than about 6. In the above formulas, M is Na or K.

Reaction 2

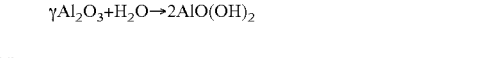

$$\gamma Al_2O_3+H_2O \rightarrow 2AlO(OH)_2$$

or

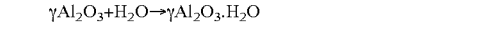

$$\gamma Al_2O_3+H_2O \rightarrow \gamma Al_2O_3.H_2O$$

or

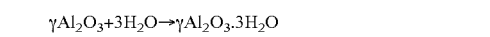

$$\gamma Al_2O_3+3H_2O \rightarrow \gamma Al_2O_3.3H_2O$$

The concentration of the sodium or potassium dichromate in the dichromate sealing solution may be in the range from about 30 to about 53 g/l, and in one embodiment from about 45 to about 53 g/l, and in one embodiment from about 30 to about 50 g/l. The temperature of the solution may be in the range from about 70° C. to about 100° C., and in one embodiment from about 71° C. to about 88° C., and in one embodiment from about 88° C. to about 100° C. The pH of the solution may be in the range from about 5 to about 6, and in one embodiment from about 5.3 to about 6.3.

The sealing solution may comprise an acetate sealing solution. The acetate solution may comprise a metal acetate, for example, nickel acetate, cobalt acetate, or a mixture thereof. The concentration of the nickel acetate may be in the range from about 5 to about 5.8 g/l. The cobalt acetate may be at a concentration in the range from about 0.9 to about 1.1 g/l. The temperature of the solution may be in the range from about 70° C. to about 100° C., and in one embodiment from about 95° C. to about 100° C., and in one embodiment from about 70° C. to about 90° C. The pH of the solution may be in the range from about 5.5 to about 5.8.

In one embodiment, the sealing process may comprise hydrolyzing the metal acetate to form metal hydroxide which is sorbed at the mouth of the pore and seals the pore. The term "sorbed" is used herein to mean adsorbed, absorbed or a combination thereof. The reaction may proceed as follows:

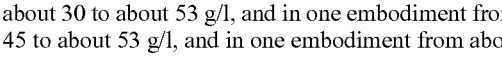

$$(CH_3COO)_2M+2H_2O \rightarrow 2CH_3COOH+M(OH)_2 \quad (1)$$

and

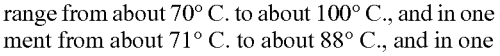

$$\gamma Al_2O_3+2M(OH)_2 \rightarrow 2AlOM\ (OH)_2 \quad (2)$$

where M is either Ni or Co.

In one embodiment, oxydichromate, oxychromate, hydroxyl, nickel hydroxide, cobalt hydroxide, or a mixture of two or more thereof, may be sorbed by the anodic coating layer.

In one embodiment, the sealing solution may further include one or more surfactants. The surfactant may be a non-ionic, anionic, or cationic surfactant. In one embodiment, the surfactant may comprise one or more of monocarboxyl imidoazoline, alkyl sulfate sodium salt, tridecyloxy poly(alkyleneoxy ethanol), ethoxylated or propoxylated alkyl phenol, alkyl sulfoamide, alkaryl sulfonate, palmitic alkanol amide, octylphenyl polyethoxy ethanol, sorbitan monopalmitate, dodecylphenyl polyethylene glycol ether, alkyl pyrrolidone, polyalkoxylated fatty acid ester, or alkylbenzene sulfonate, which are commercially available surfactants.

The anodized aluminum substrate or workpiece may be dipped or immersed in the sealing solution and held there until the pores are partially or completely sealed as indicated above. The sealing solution may be applied using a spray apparatus. The spray apparatus may be an air sprayer or an airless sprayer. The sealing solution may be applied using brush, roll, wipe, vapor deposition, or other similar application methods.

The thickness of the sealed anodic coating layer may be in the range from about 0.5 to about 115 microns, and in one embodiment in the range from about 0.5 to about 25 microns, and in one embodiment from about 12 to about 115 microns.

The silicon-containing polymer layer may be applied to the surface of the at least partially sealed anodic coating layer. In one embodiment, the silicon-containing polymer may covalently bond to the surface of the at least partially sealed anodic coating layer. In one embodiment, the silicon-containing polymer may be derived from at least one silane, at least one siloxane, or a mixture thereof.

The silicon-containing polymer layer may be formed from a single silane or siloxane material, multiple and different silane or siloxane materials, or a combination of silane materials and siloxane materials.

The siloxane may be inorganic. The siloxane may have an inorganic backbone with organic side groups. The siloxane may be formed from organic modified precursors. In one embodiment, the siloxane may include one or more alkoxy, glycidyl, epoxy, cyano, cyanato, amino or mercapto groups, or a combination of two or more thereof. The organic side groups may contain from 1 to about 30 carbon atoms per group, and in one embodiment from 1 to about 20 carbon atoms, and in one embodiment from 1 to about 12 carbon atoms, and in one embodiment from 1 to about 4 carbon atoms per group. These may be aliphatic, cyclic and/or aromatic.

The siloxane according to one embodiment of the invention may be cured to form the silicon-containing polymer. The polymer may be referred to as a polysiloxane. In one embodiment, the siloxane may be dried and/or cured at room temperature or at an elevated temperature. In one embodiment, the siloxane may be cross linked or cured by exposure to radiation. The radiation may be ultraviolet, infrared, electron beam, and/or visible light. In one embodiment, the siloxane may be chemically initiated to form linkages. The appropriate cross linking or curing method may be determined with reference to the selection of siloxane material, and may include ambient cure systems, thermal cure systems, radiation cure systems, moisture cure systems, and one or two part curing agent or cross link initiating systems.

The silane may contain one or more alkoxy groups. The silane may exhibit mono, di, tri, or tetralkoxy functionality. The alkoxy silanes may be mixed with water to hydrolyze the alkoxy silane into silanol and alcohol. For example, the following reaction of a trimethoxy silane with water may occur:

$$R—Si—(OCH_3)_3+3H_2O \rightarrow R—Si—(OH)_3+3CH_3OH$$
(evap)

The silanes may include functional groups. In one embodiment, the functional groups participate in a cross-linking reaction during the silicon-containing polymer layer formation. In one embodiment, the silane may include at least one glycidyl, amino, vinyl, ureido, epoxy, cyano, cyanato, isocyanto, mercapto, methacrylato, vinyl benzene, sulfonyl, group, or a combination of two or more of such groups. In the above formula, R may be any of these. The functional groups may be non-hydrolyzable. The silane may comprise one or more alkoxy silanes.

In one embodiment, the silicon-containing polymer may be derived from methyl trimethoxysilane, phenyltrimethoxysilane, propyltrimethoxysilane, diethoxysiloxane, ethylenediaminpropylytrimethoxysilane, glycidoxymethoxysilane, glycidoxypropyl trimethoxy silane, 1,2bis(triethoxysilyl) ethane, gamma-aminopropyl triethoxy silane, mercaptopropyl trimethoxy silane, dimethylsilane, aminopropyl silane, vinyltrimethoxysilane, bis-triethoxysilylpropyl tetrasulfone, amino trimethoxysilane, ureidopropyl trimethoxysilane, 1,2-bis-(trimethoxysilyl) ethane, 1,6-bis-(trialkoxysilyl) hexane, 1,2-bis-(triethoxysilyl) ethylene, bis-triethoxysilylpropyl tetrasulfone, or a mixture of two or more thereof.

In one embodiment, an aqueous solution of silanes may be used for application to the at least partially sealed anodic coating layer. The concentration of the silanes in this solution may be in the range from about 20% to about 60%, by weight, and in one embodiment from about 25% to about 50% by weight, and in one embodiment from about 28% to about 32%, by weight.

In one embodiment, the silane may be cross-linked or cured by exposure to moisture and/or radiation to form the silicon-containing polymer. The polymer may be referred to as a polysilane. The radiation may be ultraviolet, infrared, electron beam, and/or visible light. In one embodiment, the silane may be chemically initiated to form linkages.

In one embodiment, the silicon-containing polymer layer may be formed using Micro Guard AD-95, which is a product available from Adsil Corporation identified as a mixture of alkoxy silanes. Adsil Corporation can be contacted at www.Adsil.com. In one embodiment, the silicon-containing polymer layer may be formed using Crystal Coat MP-100, which is available from SDC Technologies and is identified as a polysiloxane based thermal cure coating material. SDC Technologies can be contacted at www.SDCTech.com.

In one embodiment, the silane or siloxane used to form the silicon-containing polymer layer may be in the form of a fluid, for example, an aqueous solution, and may be applied to the at least partially sealed anodic coating layer using a spray apparatus. The spray apparatus may be an air sprayer or an airless sprayer. In one embodiment, the silane or siloxane may be applied using dip, brush, wipe, roll, vapor deposition, or other similar application method.

The silane or siloxane may be dried at a temperature in the range from about 10° C. to about 100° C., and in one embodiment about 10° C. to about 40° C., and in one embodiment about 13° C. to about 40° C., and in one embodiment about 10° C. to about 30° C., over a period of about 0.15 to about 12 hours, and in one embodiment from about 0.15 to about 1 hour, and in one embodiment from about 8 to about 12 hours. The silane or siloxane may be cured at a temperature in the range from about 10° C. to about 150° C., and in one embodiment about 13° C. to about 40° C., and in one embodiment from about 70° C. to about 150° C., over a period of about 2 to about 12 hours, and in one embodiment from about 2 to about 4 hours, and in one embodiment from about 8 to about 12 hours. The thickness of the silicon-containing polymer layer may be in the range from about 0.5 to about 100 microns, and in one embodiment from about 0.5 to about 25 microns, and in one embodiment from about 25 to about 100 microns.

The articles treated in accordance with the invention exhibit enhanced corrosion resistance properties. In one embodiment, these articles may exhibit one or more of enhanced durability, weathering, pitting resistance, abrasion resistance, scratch resistance, chemical resistance including resistance to alkaline and acidic environments. In one embodiment, these articles may exhibit enhanced resistance to one or more of salts (for example, sodium chloride, potassium chloride, and the like), thermal cycling, fatigue, and/or airplane de-icing solutions.

The following examples are intended to illustrate embodiments of the invention, and, as such, should not be construed as imposing limitations upon the claims.

EXAMPLE 1

Samples 1 and 2 are made using test pieces of aluminum alloy 2024-T3. These samples are prepared by forming an anodized coating on the surface of each test piece and then sealing the anodized coating with sodium dichromate in accordance with military specification MIL-A-8625F, Type II, Class 1. The thickness of the resulting surface treatment layer is 7.6-15.2 microns.

Sample 1 is coated with a layer of Crystal Coat MP-100. The Crystal Coat MP-100 is applied to the anodized and sealed test pieces using air spray. The coated sample is dried under ambient conditions for 1 hour and cured in an oven at 82.2° C. for 4 hours. The thickness of the Crystal Coat MP-100 coating layer is 1.27-3.81 microns.

Sample 2 is coated with a layer of Micro Guard AD 95. Micro Guard AD 95 is a three-component material which is supplied in separate containers as Components A, B and C. Component A is poured into a high density polyethylene container. Component B is added to Component A and the resulting mixture is stirred for 15 minutes. Component C is added to the mixture and the resulting mixture is stirred for 15 minutes. The Micro Guard AD95 is applied to the anodized and sealed test pieces using air spray. The coated sample is dried under ambient conditions for 8 to 12 hours and cured at ambient conditions for 5 to 7 days.

EXAMPLE 2

Corrosion resistance tests are performed on Samples 1 and 2 in accordance with ASTM D1654 and ASTM B117 using unscribed and scribed samples, respectively. The samples are tested for 1008 hours. Samples 1 and 2 do not exhibit corrosion creep from the scribe, and exhibit minimal chromate sealant discoloration.

EXAMPLE 3

Samples 1 and 2 are tested for corrosion without carbon for 2000 hours using test methods ASTM D1654 and ASTM B117. The time in hours for observed corrosion for the unscribed/scribed conditions for Sample 1 is 1536/1536. The time in hours for observed corrosion for the unscribed/scribed conditions for Sample 2 is 1536/1416.

EXAMPLE 4

Samples 1 and 2 are tested for corrosion with carbon for 168 hours using test method ASTM B117. The time in hours for observed corrosion for Samples 1 and 2 is 144 hours.

EXAMPLE 5

Samples 1 and 2 are tested for humidity resistance for 720 hours at 95% relative humidity and 49° C. in accordance with test method ASTM D2247 using unscribed samples. Samples 1 and 2 do not corrode or exhibit chromate sealant discoloration.

EXAMPLE 6

Fluid resistance tests are performed on Samples 1 and 2 using a variety of aircraft fluids at ambient conditions using unscribed panels. Samples 1 and 2 are exposed to hydraulic fluid, grease, oil, and cleaning agents individually for a period of 720 hours. Samples 1 and 2 are exposed to jet fuel and de-icing fluids individually for a period of 168 hours. Samples 1 and 2 do not corrode or exhibit chromate sealant discoloration.

While the invention has been explained in relation to specific embodiments, various modifications thereof will become apparent to those skilled in the art upon reading the specification. Therefore, it is to be understood that the invention disclosed herein is intended to cover such modifications as fall within the scope of the appended claims.

The invention claimed is:

1. An article, comprising:

a substrate having a surface comprising aluminum or an aluminum alloy;

a sealed anodic coating layer overlying at least part of the surface of the substrate, wherein the sealed anodic coating layer has a surface and comprises (a) a porous anodic coating coating an outside surface and a plurality of pores on the outside surface of the anodic coating layer, and (b) a sorbed compound completely sealing the plurality of pores; and a layer of a silicon-containing polymer overlying the surface of the sealed anodic coating layer, the silicon-containing polymer derived from at least one silane, at least one siloxane, or a mixture thereof.

2. The article of claim 1, wherein the aluminum alloy comprises aluminum and at least one alloying constituent, the alloying constituent comprising copper, manganese, silicon, magnesium, zinc, zirconium, silver, or a mixture of two or more thereof.

3. The article of claim 1 wherein the aluminum alloy comprises aluminum and at least one alloying constituent, the alloying constituent comprising copper.

4. The article of claim 1 wherein the aluminum alloy comprises aluminum and at least one alloying consitutent, the alloying constituent comprising zinc.

5. The article of claim 1 wherein the aluminum alloy comprises from about 90.4 to about 95% by weight aluminum, from about 3.9 to about 5% by weight copper, from about 0.2 to about 0.8% by weight magnesium, from about 0.4 to about 1.2% by weight manganese, from about 0.5 to about 1.2% by weight silicon, up to about 0.1% by weight chromium, up to about 0.7% by weight iron, up to about 0.15% by weight titanium, and up to about 0.25% by weight zinc.

6. The article of claim 1 wherein the aluminum alloy comprises from about 87.3 to about 90.3% by weight aluminum, from about 5.7 to about 6.7% by weight zinc, from about 2 to about 2.6% by weight copper, from about 1 .9 to about 2.6% by weight magnesium, from about 0.08 to about 0.15% by weight zirconium, up to about 0.04% by weight chromium, up to about 0.15% by weight iron, up to about 0.06% by weight titanium, up to about 0.1% by weight manganese, and up to about 0.12% by weight silicon.

7. The article of claim 1 wherein the aluminum alloy comprises from about 91.2 to 93.6% by weight aluminum, from about 4.8 to about 5.4% by weight of copper, from about 0.7 to about 1.1% by weight magnesium, from about 0.45 to about 1.0% by weight manganese, from about 0.40 to about 0.70% by weight silver, from about 0.08 to about 0.15% by weight of zirconium, up to about 0.25% by weight zinc, up to about 0.10% by weight iron, up to about 0.08% by weight silicon, up to about 0.06% by weight titanium, and up to about 0.05% by weight chromium.

8. The article of claim 1 wherein the aluminum alloy meets the standards set by the Aluminum Association for a Series 2009, 2014, 2016, 2017, 2024, 2040, 2080, 2117, 2214, 2618, 6013, 6061, 6091, 6092, 6113, 7005, 7009, 7010, 7033, 7049, 7050, 7075, 7085, 7093, 7175 or 7250 alloy.

9. The article of claim 1 wherein the alloy meets the standards set by the Aluminum Association for a Series 355.0, C355.0, 356.0, A356.0 or A357.0 alloy.

10. The article of claim 1, wherein the anodic coating layer is formed using a sulfuric acid bath, a chromic acid bath or a phosphoric acid bath.

11. The article of claim 1 wherein the anodic coating layer is formed using a sulfuric acid bath.

12. The article of claim 1 wherein the anodic coating layer comprises a barrier region overlying the aluminum substrate and a porous region overlying the barrier region.

13. The article of claim 1 wherein oxydichromate, oxychromate, hydroxyl, nickel hydroxide, cobalt hydroxide, or a mixture of two or more thereof, is sorbed by the anodic coating layer.

14. The article of claim 1, wherein the silicon-containing polymer is derived from methyl trimethoxysilane, phenyltrimethoxysilane, propyltrimethoxysilane, diethoxysiloxane, ethylenediaminopropylytrimethoxysilane, glycidoxymethoxysilane, glycidoxypropyl trimethoxy silane, 1,2 bis (triethoxysilyl) ethane, gamma-aminopropyl triethoxy silane, mercaptopropyl trimethoxy silane, dimethylsilane, aminopropyl silane, vinyltrimethoxysilane, bis-triethoxysilylpropyl tetrasulfone, amino trimethoxysilane, ureidopropyl trimethoxysilane, 1,2-bis-(trimethoxysilyl) ethane, 1,6-bis- (trialkoxysilyl) hexane, 1,2-bis-(triethoxysilyl) ethylene, bis-triethoxysilylpropyl tetrasulfone, or a mixture of two or more thereof.

15. The article of claim 1 wherein the thickness of the sealed anodic coating layer is in the range from about 0.5 to about 115 microns.

16. The article of claim 1 wherein the thickness of the sealed anodic coating layer is in the range from about 0.5 to about 25 microns.

17. The article of claim 1 wherein the thickness of the sealed anodic coating layer is in the range from about 12 to about 115 microns.

18. The article of claim 1 wherein the silicon-containing polymer layer has a thickness in the range from about 0.5 to about 100 microns.

19. The article of claim 1 wherein the silicon-containing polymer layer has a thickness in the range from about 25 to about 100 microns.

20. The article of claim 1 wherein the silicon-containing polymer layer has a thickness in the range from about 0.5 to about 25 microns.

21. The article of claim 1 wherein the article is a wheel or brake component.

22. The article of claim 1 wherein the article is an aircraft wheel or brake component.

23. The article of claim 1, wherein the silicon-containing compound is derived from at least one siloxane.

24. The article of claim 1 comprising an aluminum alloy, wherein the aluminum alloy meets the standards set by the Aluminum Association for a Series 2XXX alloy, 6XXX alloy, 7XXX alloy, or 3XX.X alloy.

25. A method of treating a substrate having a surface comprising an aluminum alloy, the method comprising:

forming an anodic coating layer overlying at least part of the surface of the substrate, the anodic coating layer comprising an outside surface and a plurality of pores on the outside surface;

completely sealing the plurality of pores of the anodic coating layer to form a sealed anodic coating layer having an outside surface; and forming a silicon-containing polymer layer overlying the outside surface of the sealed anodic coating layer, the silicon-containing polymer derived from at least one alkoxysilane.

26. A method of treating a substrate, the substrate having a surface comprising an aluminum alloy, the process comprising:

forming an anodic coating layer overlying at least part of the surface of the substrate, the anodic coating layer being formed using a sulfuric acid bath, wherein the anodic coating layer comprises an outside surface and a plurality of pores on the outside surface;

completely sealing the plurality of pores of the anodic coating layer using water and/or a sealing solution to form a sealed anodic coating layer having an outside surface, the sealing solution comprising water and one or more of sodium dichromate, potassium dichromate, nickel acetate or cobalt acetate; and forming a silicon-containing polymer layer over the outside surface of the sealed anodic coating layer, the silicon containing polymer derived from at least one alkoxysilane.

* * * * *

UNITED STATES PATENT AND TRADEMARK OFFICE

CERTIFICATE OF CORRECTION

PATENT NO. : 7,527,872 B2
APPLICATION NO. : 11/258395
DATED : May 5, 2009
INVENTOR(S) : Leslie Scotte Steele et al.

It is certified that error appears in the above-identified patent and that said Letters Patent is hereby corrected as shown below:

Col. 9, line 58, “coating coating” should read --coating containing--.

Col. 10, line 21, “1 .9” should read --1.9--.

Signed and Sealed this
Twenty-eighth Day of December, 2010

David J. Kappos

David J. Kappos
*Director of the United States Patent and Trademark Office*